US009342019B2

(12) United States Patent
Shirasaki et al.

(10) Patent No.: US 9,342,019 B2
(45) Date of Patent: May 17, 2016

(54) IMAGE FORMING APPARATUS

(71) Applicants: Yoshinori Shirasaki, Osaka (JP); Masayuki Hayashi, Osaka (JP); Motohiro Kawanabe, Osaka (JP); Masatoshi Murakami, Osaka (JP)

(72) Inventors: Yoshinori Shirasaki, Osaka (JP); Masayuki Hayashi, Osaka (JP); Motohiro Kawanabe, Osaka (JP); Masatoshi Murakami, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 42 days.

(21) Appl. No.: 14/511,814

(22) Filed: Oct. 10, 2014

(65) Prior Publication Data

US 2015/0125170 A1 May 7, 2015

(30) Foreign Application Priority Data

Nov. 6, 2013 (JP) ..... 2013-230721

(51) Int. Cl.

| | |
|---|---|
| ***G03G 15/01*** | (2006.01) |
| ***G03G 21/00*** | (2006.01) |
| ***G03G 15/00*** | (2006.01) |
| *G03G 15/043* | (2006.01) |

(52) U.S. Cl.

CPC ..... *G03G 15/5054* (2013.01); *G03G 15/043* (2013.01)

(58) Field of Classification Search

CPC ..... G03G 15/5054; G03G 15/043; G03G 15/04036; G03G 2215/0409

USPC ..... 399/301, 198

See application file for complete search history.

(56) References Cited

U.S. PATENT DOCUMENTS

| | | | | |
|---|---|---|---|---|
| 2003/0146954 | A1* | 8/2003 | Tamura | B41J 2/04581 347/50 |
| 2008/0130021 | A1* | 6/2008 | Inoue | H04N 1/295 358/1.7 |
| 2011/0268461 | A1 | 11/2011 | Shirasaki et al. | |
| 2012/0154827 | A1 | 6/2012 | Shirasaki et al. | |
| 2013/0004194 | A1 | 1/2013 | Shirasaki et al. | |
| 2013/0044176 | A1 | 2/2013 | Shirasaki et al. | |
| 2014/0049591 | A1 | 2/2014 | Shirasaki et al. | |

FOREIGN PATENT DOCUMENTS

| | | |
|---|---|---|
| JP | 2012-126083 | 7/2012 |
| JP | 2013-039798 | 2/2013 |
| JP | 2013-109295 | 6/2013 |
| JP | 2014-037082 | 2/2014 |

* cited by examiner

*Primary Examiner* — Billy Lactaoen

(74) *Attorney, Agent, or Firm* — Oblon, McClelland, Maier & Neustadt, L.L.P

(57) ABSTRACT

An image forming apparatus includes an exposure control unit that performs control, based on a shift-amount of an exposure position from an ideal position, the shift-amount being obtained from a detection-result of a misregistration correcting pattern image, to shift at least one of an exposure timing corresponding to first image data which is input to one of two electric cables in contact with a target electric cable and an exposure timing corresponding to second image data which is input to another one of the two electric cables, with respect to an exposure timing corresponding to target image data being input to the target electric cable both sides of which are in contact with the two other electric cables, among a plurality of the electric cables which corresponds respectively to a plurality of the exposure units provided for each of a plurality of colors.

7 Claims, 9 Drawing Sheets

FIG.6

| | | | | | | | | | | | |
|---|---|---|---|---|---|---|---|---|---|---|---|
| 100a (K) | GND | TRANS-FER clk (P) | TRANS-FER clk (N) | GND | CON-TROL SIGNAL | DATA SIGNAL [7:0] | CON-TROL SIGNAL | GND | POWER SOURCE | GND | POWER SOURCE |
| 100b (C) | GND | TRANS-FER clk (P) | TRANS-FER clk (N) | GND | CON-TROL SIGNAL | DATA SIGNAL [7:0] | CON-TROL SIGNAL | GND | POWER SOURCE | GND | POWER SOURCE |
| 100c (M) | GND | TRANS-FER clk (P) | TRANS-FER clk (N) | GND | CON-TROL SIGNAL | DATA SIGNAL [7:0] | CON-TROL SIGNAL | GND | POWER SOURCE | GND | POWER SOURCE |
| 100d (Y) | GND | TRANS-FER clk (P) | TRANS-FER clk (N) | GND | CON-TROL SIGNAL | DATA SIGNAL [7:0] | CON-TROL SIGNAL | GND | POWER SOURCE | GND | POWER SOURCE |

FIG.7

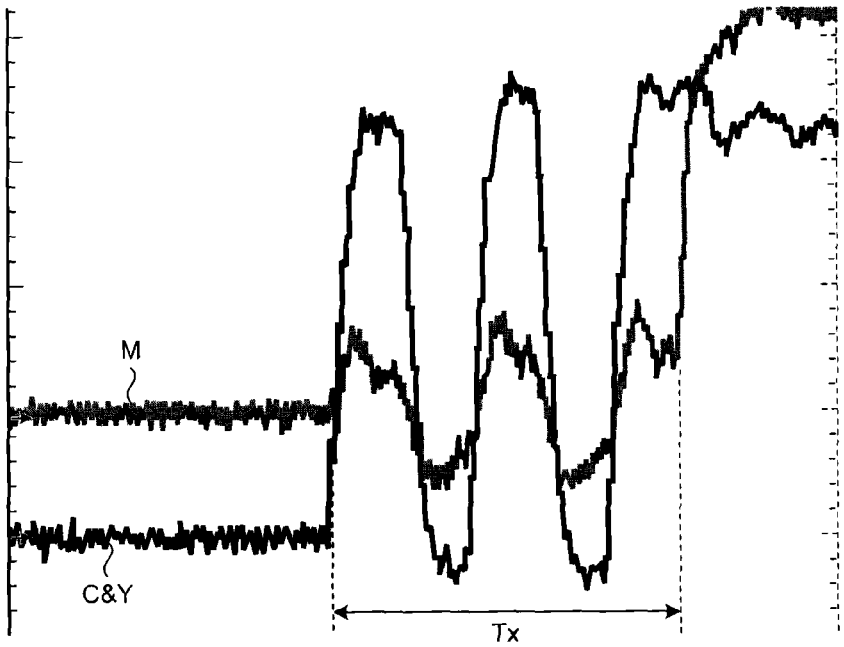

IMAGE FORMING APPARATUS

CROSS-REFERENCE TO RELATED APPLICATIONS

The present application claims priority to and incorporates by reference the entire contents of Japanese Patent Application No. 2013-230721 filed in Japan on Nov. 6, 2013.

BACKGROUND OF THE INVENTION

1. Field of the Invention

The present invention relates to an image forming apparatus.

2. Description of the Related Art

A flexible flat cable (hereinafter noted as an "FFC" in some cases) is known in the related art as a member connecting a circuit board to another circuit board that are provided inside an electronic device. The thinness and flexibility of the FFC contribute greatly in downsizing current electronic devices that are made smaller. The FFC is thus often used in an image forming apparatus employing an electrophotographic method as well. It is known that the FFC is used to connect a control board and an LEDA especially when the LEDA is used as a light source for the electrophotography.

When the image forming apparatus has a plurality of LEDAs, it is convenient to arrange the LEDAs in parallel with one another and in the same direction for the reason of allowing wiring paths of the FFC to be shared, for example. The FFC folded a fewer number of times is less expensive since it costs more, as a processing cost, to increase the number of folds of the FFC. As a result, a reduced cost is achieved by wiring (arranging) the FFCs on top of one another within a device. That is, it is unique to the image forming apparatus that the FFCs are wired on top of one another within the device.

However, a problem called crosstalk occurs when a signal is transferred through the FFCs wired on top of one another. The crosstalk refers to an existing state where a magnetic field is generated around a wire every time a signal is driven along the wire so that, when two wires are disposed adjacently to each other, two magnetic fields act on each other to generate cross coupling of energy between signals. Data is not transferred accurately when the crosstalk occurs. Accordingly, there is known a technology to avoid the effect of crosstalk by providing a contact inhibition mechanism which inhibits the FFCs from contacting one another. Moreover, Japanese Laid-Open Patent Publication No. 2013-109295 for example discloses a configuration where a light emission timing is changed by controlling a data transfer timing to the LEDA for the purpose of preventing current consumption from being increased when each LEDA is turned on at the same time in eliminating static from a photoconductor.

However, the technology in the conventional art has problems that the cost is increased by the addition of a new component and that the effect caused by the crosstalk cannot be avoided at the time of performing normal print data transfer.

In view of the aforementioned problems, there is a need to provide an image forming apparatus which can avoid the effect caused by the crosstalk with a simple configuration.

SUMMARY OF THE INVENTION

It is an object of the present invention to at least partially solve the problems in the conventional technology.

According to the present invention, there is provided an image forming apparatus comprising: an exposure unit that performs exposure according to image data and forms a latent image based on the image data on a photoconductor; a detection unit that detects a misregistration correcting pattern image formed on an image bearer being driven at a predetermined speed; a calculation unit that calculates a correction amount according to a result of detection of the misregistration correcting pattern image performed by the detection unit, the correction amount indicating an amount of shift of an exposure position from an ideal position; and an exposure control unit that performs control, on the basis of the correction amount, to shift at least one of an exposure timing corresponding to first image data which is input to one of two electric cables in contact with a target electric cable and an exposure timing corresponding to second image data which is input to another one of the two electric cables, with respect to an exposure timing corresponding to target image data which is input to the target electric cable indicating the electric cable, both sides of which are in contact with the two other electric cables, among a plurality of the electric cables which corresponds one-to-one to each of a plurality of the exposure units provided for each of a plurality of colors, to which image data of a corresponding color is input, and which is connected to a corresponding one of the exposure units.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a diagram explaining a cross section of FFCs disposed on top of one another in the image forming apparatus;

FIG. 7 is a diagram illustrating an example of a waveform of crosstalk;

DETAILED DESCRIPTION OF THE PREFERRED EMBODIMENTS

Embodiments of an image forming apparatus according to the present invention will now be described in detail with reference to the drawings. The image forming apparatus of the present invention can be applied to an apparatus which forms an image by an electrophotographic method such as an image forming apparatus or multifunction peripheral (MFP: Multifunction Peripheral) employing the electrophotographic method. Note that the multifunction peripheral is an apparatus having at least two of a print function, a copy function, a scanner function, and a facsimile function.

Figure 1:
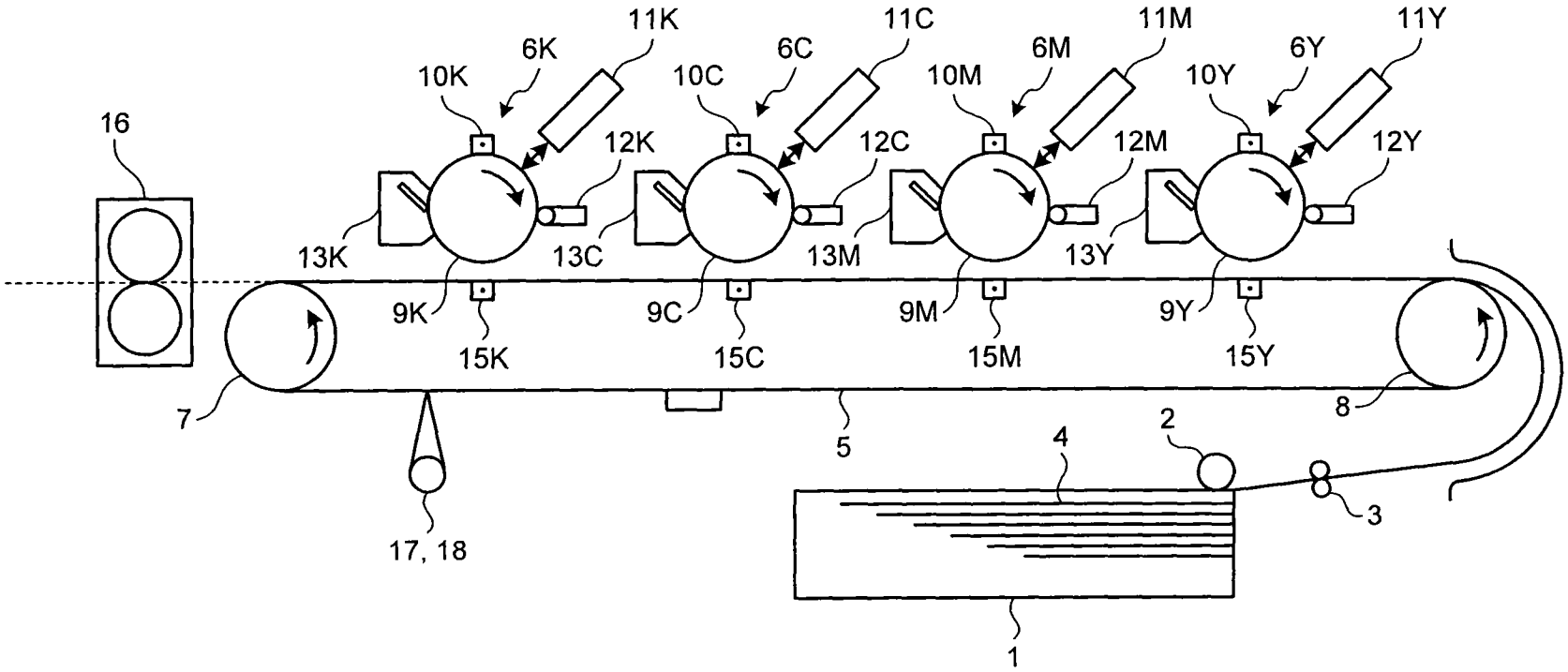
FIG. 1 is a diagram mainly illustrating an example of a configuration of a part of a general electrophotographic apparatus, the part performing image formation.

FIG. 1 is a diagram mainly illustrating an example of a configuration of a part of a general electrophotographic apparatus, the part performing image formation. The electrophotographic apparatus illustrated in FIG. 1 includes a configuration where image forming units are arranged side by side along a conveying belt 5 that is an endless move unit so that the apparatus is referred to as a so-called tandem type, the image forming units including an image forming unit (electrophotography processing unit) 6C forming an image in C (cyan), an image forming unit 6M forming an image in M (magenta), an image forming unit 6Y forming an image in Y (yellow), and an image forming unit 6K forming an image in K (black; also noted as Bk in some cases). Each of the image forming units 6Y, 6M, 6C, and 6K may hereinafter be simply noted as an "image forming unit 6" when the image forming units are not to be distinguished from one another. The electrophotographic apparatus illustrated in FIG. 1 employs a method of directly transferring an image from a photoconductor drum, on which exposure is performed according to image data, to a recording medium such as a sheet of paper.

As illustrated in FIG. 1, the plurality of image forming units 6Y, 6M, 6C, and 6K are arrayed along the conveying belt 5 in this order from an upstream side of a conveyance direction of the conveying belt 5 which conveys paper 4 that is discharged from a paper feeding tray 1 and separated and fed by a paper feeding roller 2 and a separation roller 3. The plurality of image forming units 6Y, 6M, 6C, and 6K only differ in colors of a toner image formed but have a common internal configuration. While the following description is provided specifically for the image forming unit 6Y, each component of the other image forming units 6M, 6C, and 6K will only be illustrated in the drawings as reference numerals by replacing Y assigned to each component of the image forming unit 6Y with M, C, K to distinguish each of the other image forming units, and will not be described because the other image forming units 6M, 6C, and 6K have the same configuration as the image forming unit 6Y.

The conveying belt 5 is an endless belt wound around a driving roller 7 and a driven roller 8 that are rotationally driven. The driving roller 7 is rotationally driven by a drive motor not illustrated so that the drive motor, the driving roller 7, and the driven roller 8 together function as a driving unit which moves the conveying belt 5 that is an endless move unit. In forming an image, an uppermost sheet of the paper 4 stored in the paper feeding tray 1 is discharged one by one therefrom, adsorbed to the conveying belt 5 by the action of electrostatic adsorption, and conveyed to the first image forming unit 6Y by the conveying belt 5 that is rotationally driven, whereby a yellow toner image is transferred to the paper.

As illustrated in FIG. 1, the image forming unit 6Y includes a photoconductor drum 9Y as a photoconductor, a charging unit 10Y disposed around the photoconductor drum 9Y, an LEDA head 11Y, a developing device 12Y, a photoconductor cleaner (not illustrated), and a destaticizing unit 13Y. The LEDA head 11Y is configured to expose the photoconductor drum 9Y.

In forming an image, an outer peripheral surface of the photoconductor drum 9Y is uniformly charged in the dark by the charging unit 10Y and then exposed by irradiation light emitted from the LEDA head 11Y and corresponding to a yellow image, whereby an electrostatic latent image is formed on the outer peripheral surface. The developing device 12Y uses a yellow toner to turn this electrostatic latent image into a visible image. The yellow toner image is formed on the photoconductor drum 9Y as a result. The yellow toner image formed on the photoconductor drum 9Y is transferred onto the paper 4 by the action of a transfer unit 15Y at a position (transfer position) where the photoconductor drum 9Y and the paper 4 on the conveying belt 5 are brought into contact with each other. An image by the yellow toner is formed on the paper 4 as a result of this transfer. Unwanted toner remaining on the outer peripheral surface of the photoconductor drum 9Y having completed the transfer of the toner image is wiped out by the photoconductor cleaner, and then the photoconductor drum is destaticized by the destaticizing unit 13Y and stands by for next image formation.

The paper 4 on which the yellow toner image is transferred by the image forming unit 6Y as described above is conveyed to the next image forming unit 6M by the conveying belt 5. A magenta toner image is formed on a photoconductor drum 9M of the image forming unit 6M by the same process as the image forming process performed by the image forming unit 6Y, whereby the magenta toner image is transferred by being superimposed onto the yellow toner image formed on the paper 4. The paper 4 is further conveyed to the next image forming units 6C and 6K so that a cyan toner image formed on a photoconductor drum 9C and a black toner image formed on a photoconductor drum 9K are successively superimposed and transferred onto the paper 4 by the same operation. As a result, a full-color image is formed on the paper 4. That is, in the example illustrated in FIG. 1, the image forming unit 6 forms the images in a plurality of colors on top of one another onto the recording medium (paper 4) driven at a predetermined speed. The paper 4 on which the full-color superimposed image is formed comes off the conveying belt 5 and is sent to a fixing device 16. The fixing device 16 fixes the superimposed image on the paper 4 by applying heat and pressure. The paper 4 to which the image is fixed is then discharged outside the electrophotographic apparatus.

In the aforementioned image forming apparatus employing the electrophotographic method, the toner image in each color is not superimposed correctly when the transfer position of each color is shifted, which causes the image quality of a printed image to be degraded. It is thus required to correct the shift in the transfer position of each color (required to correct misregistration of an image of each color). In the electrophotographic apparatus illustrated in FIG. 1, a misregistration correcting pattern image is formed on the conveying belt 5 that is an image bearer in order to correct the misregistration. Sensors 17 and 18 are provided on a downstream side (downstream side of a direction in which the conveying belt 5 is driven) of each of the photoconductor drums (9Y, 9M, 9C, and 9K) to detect the misregistration correcting pattern image formed on the conveying belt 5.

Each of the sensors 17 and 18 is configured by a light reflecting sensor such as a TM sensor and includes a light source which emits a light beam toward an object to be detected and a light detection element which detects light reflected from the object to be detected. In the example illustrated in FIG. 1, the sensors 17 and 18 are disposed while aligned in a direction (main-scanning direction) orthogonal to the direction (conveyance direction and a sub-scanning direction) in which the conveying belt 5 is driven. Note that while the two sensors (17 and 18) are disposed along the main-scanning direction in the example illustrated in FIG. 1, the number and a position of sensors detecting the misregistration correcting pattern image can be modified arbitrarily.

Figure 2:
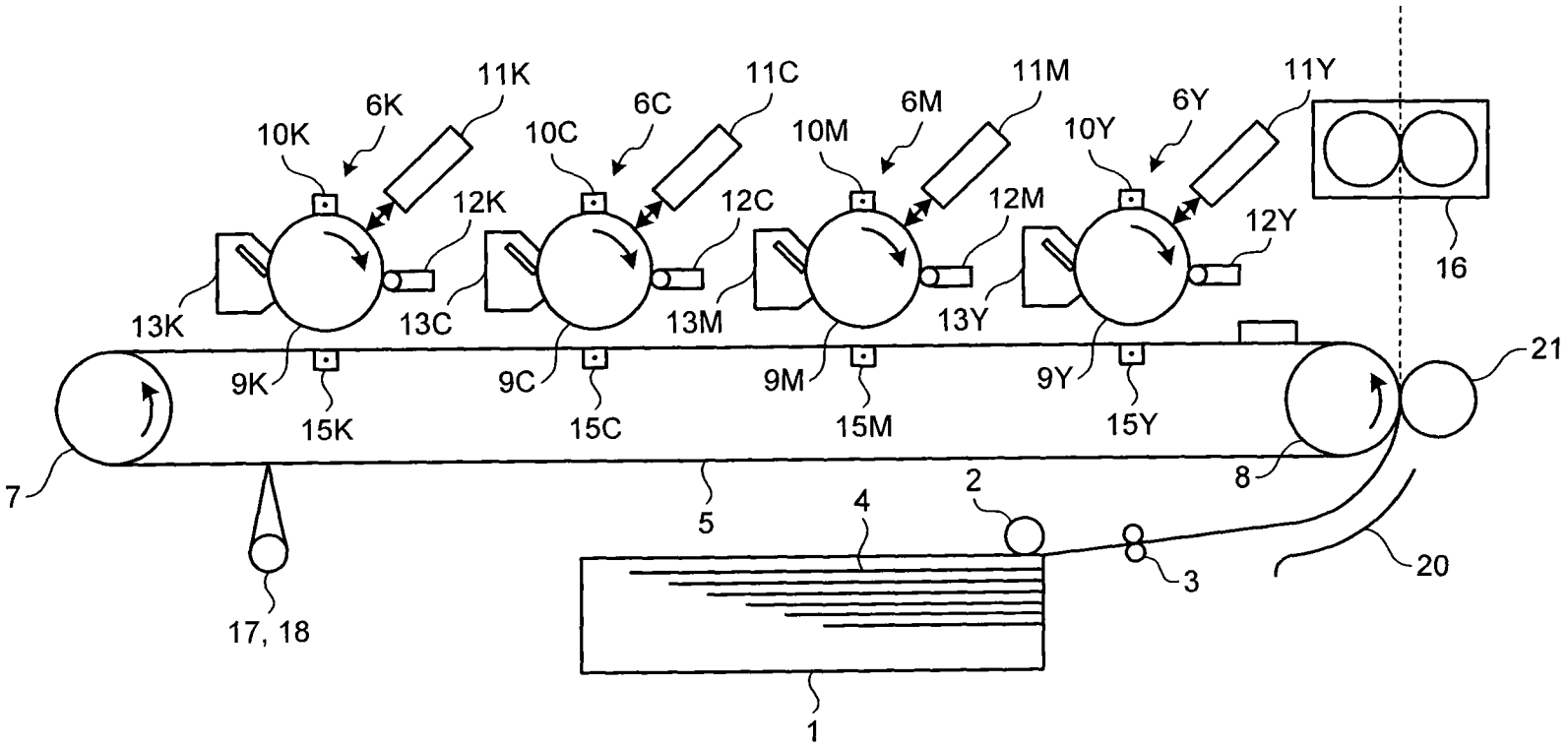
FIG. 2 is a diagram mainly illustrating an example of a configuration of a part of a general electrophotographic apparatus, the part performing image formation.

The electrophotographic apparatus illustrated in FIG. 1 is the apparatus employing the method of directly transferring the image to the recording medium, whereas an electrophotographic apparatus illustrated in FIG. 2 is an apparatus employing a method of transferring a toner image formed on an intermediate transfer belt 5 to the recording medium such as the paper 4.

In an example illustrated in FIG. 2, although the same reference numeral 5 is used, the endless move unit is not the conveying belt but the intermediate transfer belt 5. The intermediate transfer belt 5 is an endless belt wound around a driving roller 7 and a driven roller 8 that are rotationally driven. A toner image of each color is transferred onto the intermediate transfer belt 5 by the action of transfer units 15Y, 15M, 15C, and 15K at a position (primary transfer position) where photoconductor drums 9Y, 9M, 9C, and 9K are in contact with the intermediate transfer belt 5. This transferring forms a full-color image, in which the toner image of each color is superimposed on top of each other, on the intermediate transfer belt 5. That is, in the example illustrated in FIG. 2, an image forming unit 6 forms the images in a plurality of colors on top of one another onto an image bearer (the intermediate transfer belt 5) that is driven at a predetermined speed. In forming an image, an uppermost sheet of paper 4 stored in a paper feeding tray 1 is discharged one by one therefrom and conveyed to the intermediate transfer belt 5. The full-color toner image formed on the intermediate transfer belt 5 is transferred onto the paper 4 by the action of a secondary transfer roller 21 at a position (secondary transfer position 20) where the intermediate transfer belt 5 is in contact with the paper 4. The secondary transfer roller 21 is in close contact with the intermediate transfer belt 5 where a contact/separation mechanism is not provided. As a result, a full-color image is formed on the paper 4. The paper 4 on which the full-color superimposed image is formed is sent to the fixing device 16, which fixes the image to the paper 4, and is then discharged to the outside.

In the example illustrated in FIG. 2, a misregistration correcting pattern image is formed on the intermediate transfer belt 5 that is an image bearer in order to correct misregistration. Sensors 17 and 18 are provided on a downstream side (downstream side of a direction in which the intermediate transfer belt 5 is driven) of each of the photoconductor drums (9Y, 9M, 9C, and 9K) to detect the misregistration correcting pattern image formed on the intermediate transfer belt 5.

Both the electrophotographic apparatus illustrated in FIG. 1 and the electrophotographic apparatus illustrated in FIG. 2 can be used as the image forming apparatus according to the present embodiment. The image forming apparatus of the present embodiment will be referred to as an "image forming apparatus 1000" in the following description.

Figure 3:
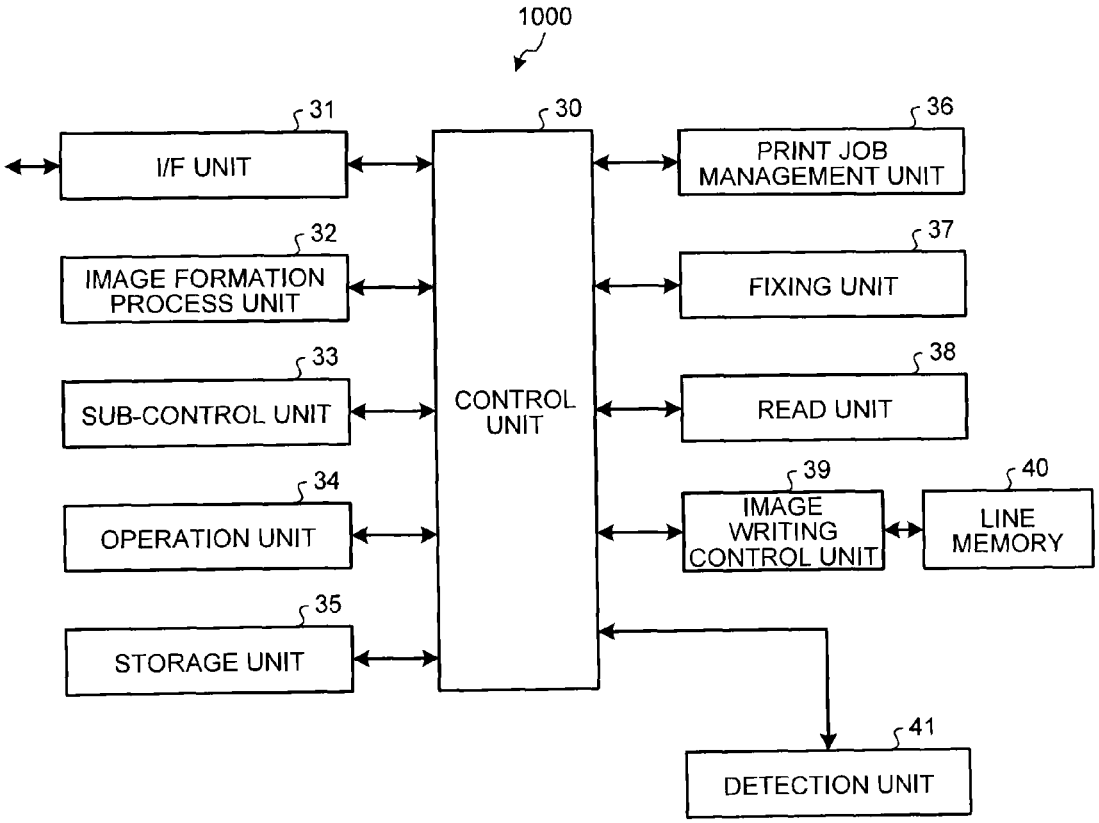
FIG. 3 is a functional block diagram illustrating an example of a configuration provided to control the image forming apparatus of an embodiment of the present invention.

FIG. 3 is a functional block diagram illustrating an example of a configuration provided to control the image forming apparatus 1000 of the present embodiment. As illustrated in FIG. 3, the image forming apparatus 1000 includes a control unit 30, an I/F (interface) unit 31, an image formation process unit 32, a sub-control unit 33, an operation unit 34, a storage unit 35, a print job management unit 36, a fixing unit 37, a read unit 38, an image writing control unit 39, a line memory 40, and a detection unit 41. These functions are configured by a combination of software and hardware. Specifically, the image forming apparatus 1000 is equipped with a normal computer device including a CPU, a ROM, a RAM and the like, so that the function of each of the aforementioned components can be configured by the combination of a software function, which is provided when the CPU reads a program stored in the ROM or the like on the RAM and executes the program, and a function realized by hardware such as a semiconductor integrated circuit.

Note that the program executed by the image forming apparatus 1000 (the program executed by the CPU) may be provided while recorded in a computer-readable recording medium in an installable or executable file format, the recording medium including a CD-ROM, a flexible disk (FD), a DVD (Digital Versatile Disk), and the like. Moreover, the program executed by the image forming apparatus 1000 may be stored on a computer connected to a network such as the Internet, and provided by causing the computer to download the program via the network. The program executed by the image forming apparatus 1000 may also be provided or distributed via a network such as the Internet.

The I/F unit 31 illustrated in FIG. 3 communicates with a terminal (such as a personal computer (PC)) which makes a print request to the image forming apparatus 1000.

The sub-control unit 33 transmits to the control unit 30 image data included in the print request that is transmitted from the terminal. The print job management unit 36 manages a printing order or the like pertaining to the print request (print job) made to the image forming apparatus 1000.

The image formation process unit 32 includes each of the aforementioned image forming units 6Y, 6M, 6C, and 6K and performs processing such as development and transfer of an electrostatic latent image written to each of the photoconductor drums 9Y, 9M, 9C, and 9K.

The fixing unit 37 includes the aforementioned fixing device 16 and a configuration which controls the fixing device 16, and performs processing of applying heat and pressure to the paper, onto which the toner image is transferred by the image formation process unit 32, and fixing the toner image to the paper.

The operation unit 34 has a function of receiving input to be made to the image forming apparatus 1000 and displaying a state of the image forming apparatus 1000.

The detection unit 41 includes the aforementioned sensors 17 and 18 and performs processing of detecting the misregistration correcting pattern image on the basis of a signal output from each of the sensors 17 and 18.

The storage unit 35 stores information indicating a state of the image forming apparatus 1000 at some point in time. A result of the detection of the misregistration correcting pattern image performed by the detection unit 41 is stored in the storage unit 35, for example.

The read unit 38 reads print information on the paper and converts it to an electric signal, realizing what is called a scanner function.

Under control of the control unit 30, the image writing control unit 39 converts the image data transmitted from the sub-control unit 33 to a signal controlling the LEDA head 11, and transfers the signal to the LEDA head 11 to turn on the LEDA head 11. The LEDA head 11 as a result performs exposure according to the image data and forms a latent image based on the image data onto the photoconductor drum 9. In this example, it can be considered that the LEDA head 11 corresponds to an "exposure unit" in claims. The image writing control unit 39 in this example converts each of the image data of the plurality of colors (image data for each of CMYK prints in this example) transmitted from the sub-control unit 33 to a signal that controls the LEDA head 11 corresponding to the color of the image data, thereby turning on the corresponding LEDA head 11. Concerning the image data for Y (yellow) print, for example, the image data for the Y print is converted to a signal controlling the LEDA head 11Y so that the signal is transferred to the LEDA head 11Y to turn on the LEDA head 11Y.

The line memory 40 stores the image data transmitted from the sub-control unit 33 in a temporary buffer and adjusts a skew process by image processing.

The control unit 30 controls the entire image forming apparatus 1000. The control unit 30 further includes a mediation unit which mediates data transfer on a bus, and controls data transfer among each of the aforementioned units.

The control unit 30 has a function of calculating for each color (for each of CMYK in this example) a correction amount (misregistration correction amount) indicating the amount of shift of an exposure position from an ideal position, in accordance with the result of the detection of the misregistration correcting pattern image performed by the detection unit 41. The amount of shift of the exposure position (amount of shift of an image writing position) is generated by the amount of shift caused by the tolerance of an incidence angle of an LEDA/laser beam onto the photoconductor drum 9 or the amount of shift caused by a change in conveyance speed of the image bearer (the conveying belt 5 or the intermediate transfer belt 5), where this shift appears in the detection result of the misregistration correcting pattern image. Accordingly, the detection result of the misregistration correcting pattern image can be used to correct the image writing position (or correct an exposure timing). In this example, it can be considered that the control unit 30 has a function corresponding to a "calculation unit" in claims. A variety of heretofore known technologies can be used to perform the method of calculating the correction amount described above.

Moreover, as described later in the present embodiment, each of the four LEDA heads (11Y, 11M, 11C, and 11K) corresponding one-to-one to each of the four colors CMYK is connected to the FFC (corresponding to an "electric cable" in claims) to which the image data of the corresponding color is input. In other words, there are provided four FFCs corresponding one-to-one to the four LEDA heads 11 in the present embodiment. The control unit 30 performs control, on the basis of the correction amount, to shift at least one of an exposure timing corresponding to first image data which indicates the image data input to one of two FFCs in contact with a target FFC and an exposure timing corresponding to second image data which indicates the image data input to another one of the two FFCs, with respect to an exposure timing corresponding to target image data which indicates the image data input to the target FFC (corresponding to a "target electric cable" in claims), both sides of which are in contact with the two other FFCs, among the four FFCs corresponding one-to-one to each of CMYK. Details will be described later. In this example, it can be considered that the control unit 30 has a function corresponding to an "exposure control unit" in claims. Note that in this example, the control unit 30 has both the function corresponding to the "calculation unit" in claims and the function corresponding to the "exposure control unit" in claims, but it may also be configured such that the function corresponding to the "calculation unit" in claims and the function corresponding to the "exposure control unit" in claims are provided separately.

Figure 4:
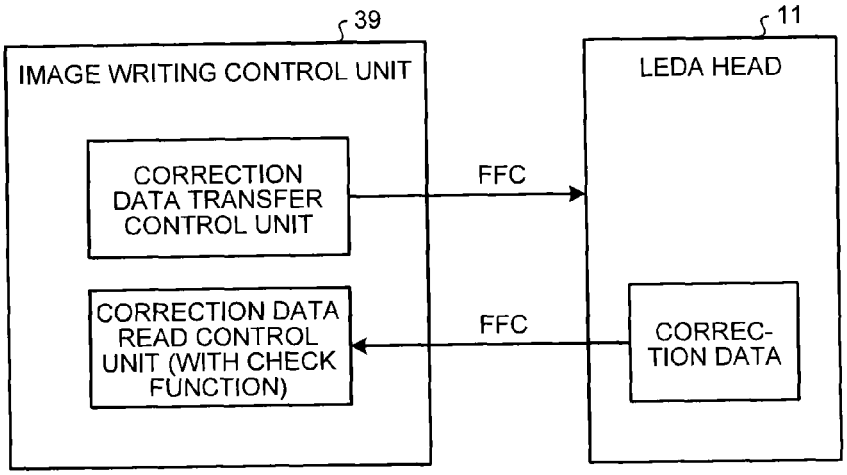
FIG. 4 is a diagram illustrating a relationship between an LEDA head and an image writing control unit.

FIG. 4 is a diagram illustrating a relationship between the LEDA head 11 and the image writing control unit 39. The image writing control unit 39 reads correction data stored in the LEDA head 11 before the LEDA head 11 emits light. The correction data stored in the LEDA head 11 in this case stores data that is used to check whether data is read correctly (parity information and check-sum information, for example). The image writing control unit 39 can therefore check whether the data being read is all correct. As for transferring, on the other hand, the data being read is subjected to processing such as arrangement conversion before being transferred, but the LEDA head 11 side is not equipped with a function to check whether or not the transferred data is correct. It is difficult to realize the data check function on the LEDA head 11 side due to problems such as "an increase in cost of the LEDA head 11" and "an increase in size of the LEDA head 11". Therefore, the correction data needs to be transferred to the LEDA head 11 more cautiously. When the correction data has not been transferred correctly, for example, there is generated degradation in image quality such as a vertical streak and a vertical band because the variation in a light emitting element cannot be corrected.

Consuming large amount of power even on stand-by, the LEDA head 11 has an energy-saving mode in which the power consumption is reduced. Information of the transferred correction data is lost once the LEDA head shifts to the energy-saving mode in the aforementioned configuration, so that the correction data need be transferred at the start of each printing.

Figure 5:
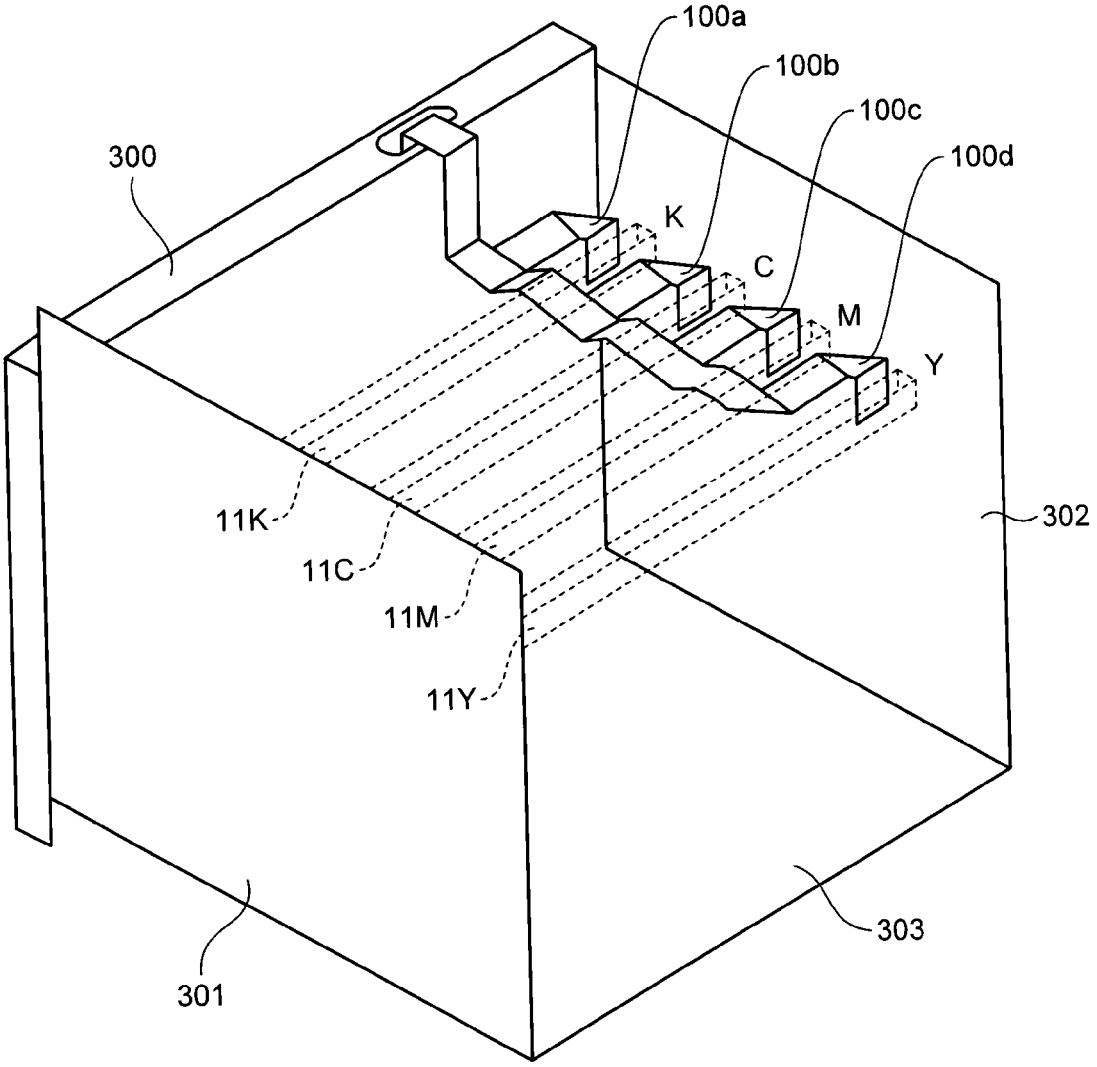
FIG. 5 is a diagram illustrating a configuration of an FFC and the LEDA head of the image forming apparatus.

FIG. 5 is a perspective view illustrating a configuration of a sheet metal frame of a color tandem machine as well as the four LEDA heads (11Y, 11M, 11C, and 11K) and the four FFCs (100*a*, 100*b*, 100*c*, and 100*d*) corresponding one-to-one to the four colors CMYK. As illustrated in FIG. 5, there are provided side face sheet metals 301 and 302 which hold the four LEDA heads 11Y, 11M, 11C, and 11K, a bottom sheet metal 303 which fixes the side face sheet metals 301 and 302 by a bottom face, and a sheet metal box 300 which fixes the side face sheet metals 301 and 302 and the bottom sheet metal 303 by a back face. Then, in order to transmit an image signal to the four LEDA heads 11, the four FFCs 100*a*, 100*b*, 100*c*, and 100*d* are passed through a hole opened at the top of the sheet metal box 300 from a control board provided inside the sheet metal box 300, whereby the control board and each LEDA head 11 are connected through the FFCs. In this example, the CPU described above is mounted to the control board, for example. Here, each of the sheet metal box 300, the side face sheet metals 301 and 302, and the bottom sheet metal 303 is grounded.

FIG. 6 is a diagram illustrating a cross section of the FFCs disposed on top of one another in the image forming apparatus 1000. The FFCs are disposed on top of one another in the same direction in the image forming apparatus 1000 illustrated in FIG. 5. The same product is used for the LEDA of each color, which means a pin assignment is identical as well, so that signals of the same kind overlap one another as illustrated in FIG. 6.

The LEDA head 11Y corresponding to Y color is connected to the control board through the FFC 100*d* in the example illustrated in FIG. 5. The LEDA head 11M corresponding to M color is connected to the control board through the FFC 100*c*. The LEDA head 11C corresponding to C color is connected to the control board through the FFC 100*b*. The LEDA head 11K corresponding to K color is connected to the control board through the FFC 100*a*.

In this configuration, both sides of the FFC 100*c* corresponding to M color are in contact with the other FFCs (100*d* and 100*b*) over a long distance. Both sides of the FFC 100*b* corresponding to C color are in contact with the other FFCs (100*a* and 100*c*) where, between the other FFCs (100*a* and 100*c*) in contact with the both sides, the FFC 100*b* is in contact with the FFC 100*c* over a long distance and in contact with the FFC 100*a* over a short distance. Only one side of the FFC 100*d* corresponding to Y color is in contact with the other FFC 100*c* over a long distance. Moreover, only one side of the FFC 100*a* corresponding to K color is in contact with the FFC 100*b* over a short distance. As a result, the effect of crosstalk through the FFC gets larger in the order of M, C, Y, K in this example. This means that the FFC 100*c* corresponding to M color is a signal line (electric cable) most susceptible to the effect of crosstalk. FIG. 7 is a diagram illustrating an example of a waveform of the crosstalk. FIG. 7 illustrates the example in which, in a predetermined period Tx, a non-zero signal is generated for the FFC 100*c* corresponding to M color by the effect of the crosstalk where a signal input to the FFC 100*c* corresponding to M color should normally be zero, the crosstalk being generated when a signal is supplied to each of the FFC 100*b* wired in contact with one of the both sides of the FFC 100*c* and the FFC 100*d* wired in contact with another side of the both sides.

Figure 8:
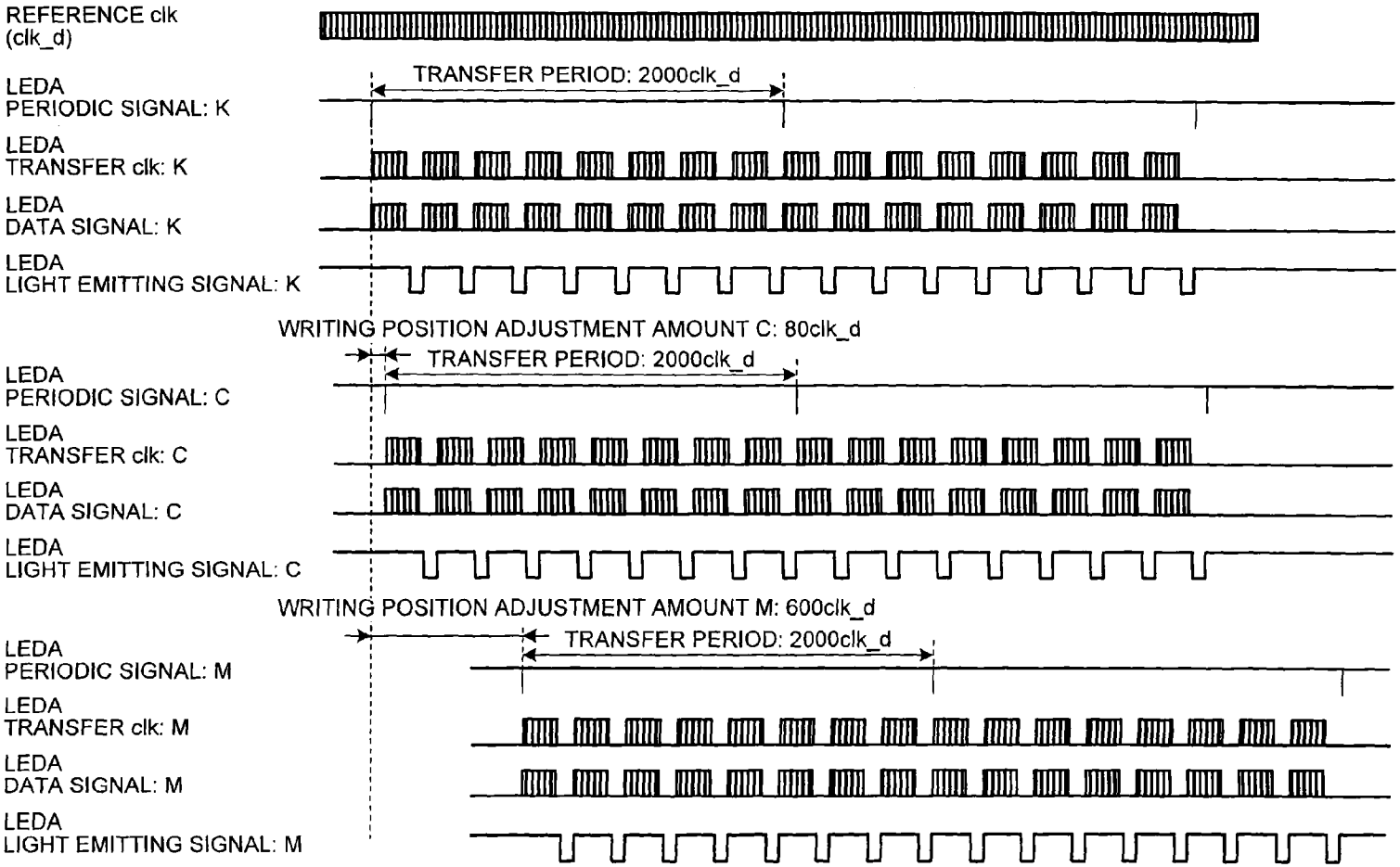
FIG. 8 is a diagram illustrating a signal set at the time of transferring image data to the LEDA head.

Next, there will be specifically described a method of transferring image data and a method of adjusting an image writing position. In transferring the image data to the LEDA head 11, the control unit 30 generates an LEDA periodic signal, an LEDA transfer clock, an LEDA data signal, and an LEDA light emitting signal in synchronization with a reference clock (clk_d) as illustrated in FIG. 8. The LEDA periodic signal is a signal setting a period in which image data corresponding to one main scanning line is transferred. The LEDA transfer clock is a signal formed by dividing the reference clock (clk_d) and used in transferring data. The LEDA data signal is a signal having a plurality of bits. The LEDA light emitting signal is a signal controlling the light emission of the LEDA head 11 after data is transferred. In the following description, an LEDA periodic signal: K represents the LEDA periodic signal input to the FFC 100*a* corresponding to K color, an LEDA transfer clock: K represents the LEDA transfer clock input to the FFC 100*a* corresponding to K color, an LEDA data signal: K represents the LEDA data signal input to the FFC 100*a* corresponding to K color, and an LEDA light emitting signal: K represents the LEDA light emitting signal input to the FFC 100*a* corresponding to K color. The signal pertaining to the other colors (C, M, and the like) will be noted in the same way.

The control unit 30 sets the LEDA periodic signal such that a required number of pieces of data can be transferred within a required time with a process line speed of the image forming apparatus 1000. Within a transfer period set by the LEDA periodic signal, the control unit uses the LEDA transfer clock and the LEDA data signal and performs control to transfer the image data to the LEDA head. The LEDA head 11 described in the present embodiment employs an eight-way split scheme where the LEDA head emits light in eight parts within the transfer period, meaning the LEDA light emitting signal is input eight times.

In order to put back the image writing position in the sub-scanning direction by the line in the present embodiment, for example, the position may be put back by the unit of one transfer period, as the method of adjusting the image writing position in the sub-scanning direction. Moreover, the image writing position may be put back by the unit of the reference clock (clk_d) in order to put back the position within the range of a single line. Where a writing position adjustment amount for K is 0 clk_d, a writing position adjustment amount for C is 80 clk_d, and a writing position adjustment amount for M is 600 clk_d (the process line speed equals 200 mm/s, the reference clock clk_d equals 40 MHz, and a single line equals 2400 dpi=10.58 μm in the present embodiment, for example) as illustrated in FIG. 8, for example, the writing position adjustment amount for C equals 0.4 μm and the writing position adjustment amount for M equals 3.0 μm. As a result, the image writing position can be adjusted with high accuracy by the line. The image writing position in the sub-scanning direction can therefore be corrected with high accuracy by correcting, separately by the line and within the single line, the correction amount (the misregistration correction amount calculated according to the detected result of the misregistration correcting pattern image) of the image writing position in the sub-scanning direction calculated by positioning control.

Figure 9:
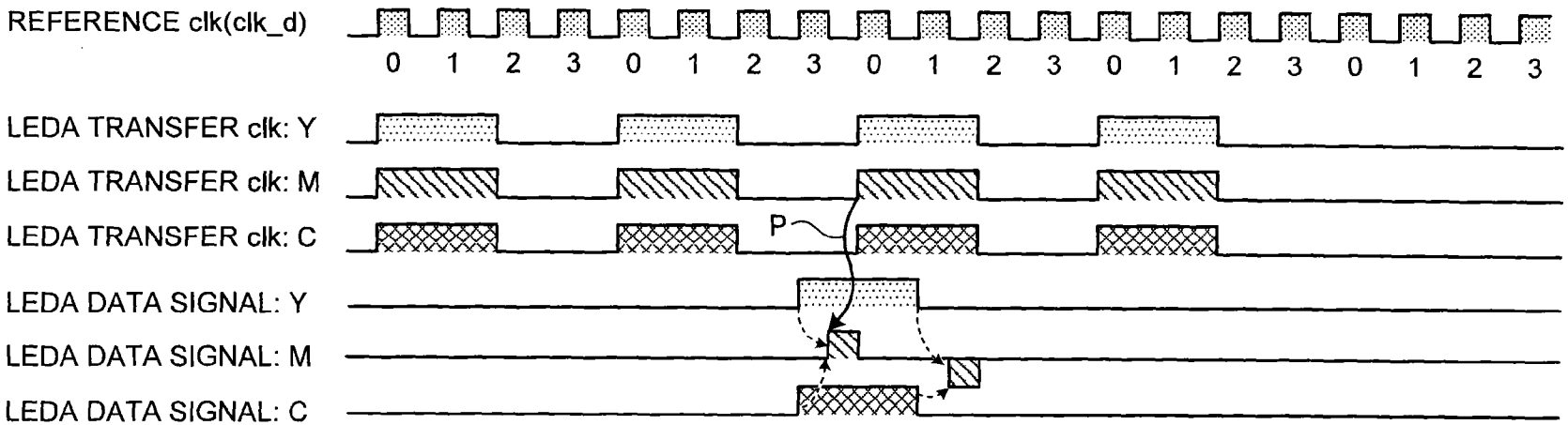
FIG. 9 is a diagram illustrating an effect caused by a specific crosstalk.

FIG. 9 is a schematic diagram specifically illustrating the effect caused by the crosstalk. The LEDA transfer clock in the present embodiment is generated by four divisions of the reference clock. This division setting is a value calculated from the machine productivity or the like and can be modified according to a condition. Moreover, the LEDA data signal is generated at a timing to have a phase difference of −90° with respect to the LEDA transfer clock. Data transfer is realized when the LEDA data signal satisfies setup/hold time that is an AC characteristic in response to a rising/falling edge of the LEDA transfer clock.

When an LEDA data signal: Y and an LEDA data signal: C are operated at the same time (in phase) and an LEDA data signal: M is not operated as illustrated in FIG. 9, the FFC 100*c* (FFC 100*c* corresponding to M color) sandwiched between the FFC 100*d* corresponding to Y color and the FFC 100*b* corresponding to C color is affected by the crosstalk as described with reference to FIG. 6, thereby causing the data signal that is originally fixed to Low (low level) to be changed to Hi (high level). While only one bit of the data signal is illustrated in FIG. 9, the LEDA data signal of the present embodiment is a signal having eight bits so that the effect of the crosstalk further increases when a plurality of bits is operated at the same timing. The effect of the crosstalk causes the LEDA data signal: M that is originally Low to be changed to Hi and, as indicated by an arrow P in FIG. 9, the setup/hold is satisfied for the LEDA transfer clock: M, causing erroneous data to be transferred.

Whether the LEDA data signal: Y and the LEDA data signal: C are operated at the same time is determined by the writing position adjustment amount within the single line that is described with reference to FIG. 8. The signals may be in phase or out of phase depending on the calculation result of the writing position adjustment amount that is calculated at will from the image writing position correction amount (misregistration correction amount) calculated by the positioning control.

As described with reference to FIG. 9, the effect caused by the crosstalk increases when the LEDA data signals are operated in phase in a plurality of channels (CH), so that the effect caused by the crosstalk can be mitigated by intentionally shifting the phase of another channel with respect to the most susceptible channel. In the present embodiment, the control unit 30 compares the misregistration correction amount (corresponding to a "first correction amount" in claims) corresponding to the image data in M color (corresponding to "target image data" in claims in this example) with each of the misregistration correction amount (corresponding to a "second correction amount" in claims) corresponding to the image data in C color (corresponding to "first image data" in claims in this example) and the misregistration correction amount (corresponding to a "third correction amount" in claims) corresponding to the image data in Y color (corresponding to "second image data" in claims in this example), adjusts the misregistration correction amount corresponding to the image data in each of C and Y colors such that the amounts do not correspond in even/odd numbers, and sets the exposure timing. More specific description is as follows.

Figure 10:
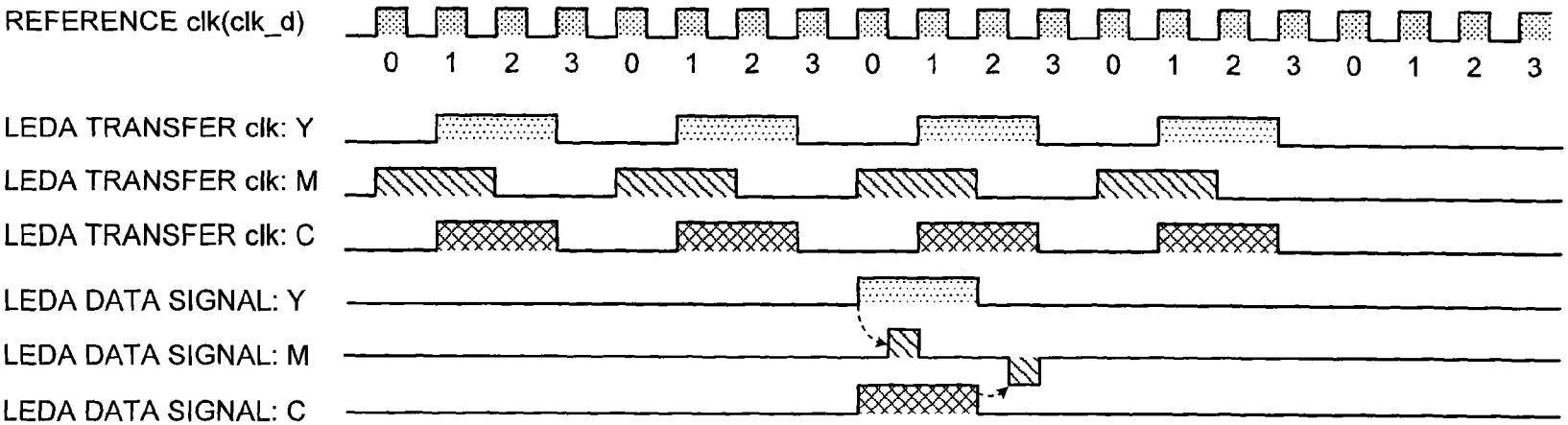
FIG. 10 is a diagram illustrating a method of avoiding the specific crosstalk.

FIG. 10 is a diagram specifically illustrating a method of avoiding the crosstalk. In this example, the misregistration correction amount (hereinafter sometimes referred to as a "writing position correction amount") corresponding to each color is not automatically used as the writing position adjustment amount corresponding to each color, but the writing position adjustment amount corresponding to the image data (the image data in C color and the image data in Y color) input to each of the FFC 100*b* and the FFC 100*d* affecting the FFC 100*c* corresponding to M color is controlled to shift the phases of the LEDA data signals: Y/C with respect to the LEDA data signal: M. Under this control, the crosstalk affects, if it does, the LEDA data signal: M at a timing which does not affect the setup/hold timing of the LEDA transfer clock: M as illustrated in FIG. 10, whereby the erroneous data is not transferred.

There will now be described a specific method of not having the two LEDA data signals: Y/C in phase with the LEDA data signal: M (there will only be described a calculation method for three CHs relevant to control, for the sake of convenience). In the following description, the writing position correction amount corresponding to the image data in C color is noted as a "writing position correction amount C1", the writing position correction amount corresponding to the image data in M color is noted as a "writing position correction amount M1", and the writing position correction amount corresponding to the image data in Y color is noted as a "writing position correction amount Y1". Moreover, the writing position adjustment amount corresponding to the image data in C color is noted as a "writing position adjustment amount C2", the writing position adjustment amount corresponding to the image data in M color is noted as a "writing position adjustment amount M2", and the writing position adjustment amount corresponding to the image data in Y color is noted as a "writing position adjustment amount Y2".

In this example, the writing position correction amounts Y1/C1 are compared with the writing position correction amount M1 to calculate the writing position adjustment amount Y2 and the writing position adjustment amount C2 such that the amounts do not correspond in the even/odd numbers. When a remainder produced by dividing the writing position correction amount Y1 by 2 matches a remainder produced by dividing the writing position correction amount M1 by 2, there are calculated the writing position adjustment amount M2=the writing position correction amount M1 (the writing position correction amount M1 is used as the writing position adjustment amount M2) and the writing position adjustment amount Y2=the writing position correction amount Y1+1 (clk_d).

When the remainder produced by dividing the writing position correction amount Y1 by 2 does not match the remainder produced by dividing the writing position correction amount M1 by 2, there are calculated the writing position adjustment amount M2=the writing position correction amount M1 and the writing position adjustment amount Y2=the writing position correction amount Y1.

When a remainder produced by dividing the writing position correction amount C1 by 2 matches the remainder produced by dividing the writing position correction amount M1 by 2, there are calculated the writing position adjustment amount M2=the writing position correction amount M1 and the writing position adjustment amount C2=the writing position correction amount C1+1 (clk_d).

When the remainder produced by dividing the writing position correction amount C1 by 2 does not match the remainder produced by dividing the writing position correction amount M1 by 2, there are calculated the writing position adjustment amount M2=the writing position correction amount M1 and the writing position adjustment amount C2=the writing position correction amount C1.

The exposure timing is set according to the writing position adjustment amount calculated as described above. Here, the writing position adjustment amount is set to a value shifted by "1" (in the unit of clk_d) from the writing position correction amount (misregistration correction amount) that is originally calculated by the positioning control. In the present embodiment with the condition described with reference to FIG. 8 (the process line speed: 200 mm/s, the reference clock clk_d: 40 MHz, one line: 2400 dpi=10.58 μm), the shift in the writing position when shifted by "1" equals 5.0 nm, which is a sufficiently small value considering that the positioning control can detect the amount of shift in the order of μm, whereby the accuracy of the positioning control is not affected.

Note that in the present embodiment where the LEDA transfer clock is generated with four divisions, the combination of even/odd numbers is the only combination that does not result in correspondence. However, the number of combinations that does not result in correspondence increases when the division setting is changed. In this case, the control unit 30 may set the exposure timing by comparing the misregistration correction amount corresponding to the image data in M color with each of the misregistration correction amount corresponding to the image data in C color and the misregistration correction amount corresponding to the image data in Y color, and adjusting the misregistration correction amount corresponding to the image data in C color and the misregistration correction amount corresponding to the image data in Y color in order to not result in correspondence with a value according to the division setting.

FIG. 10 illustrates a method of avoiding the effect of the crosstalk by causing the LEDA data signal: M to not be in phase with both the LEDA data signals: Y/C. Alternatively, there can be adopted a method of avoiding the effect of the crosstalk by causing the LEDA data signal: M to not be in phase with either one of the LEDA data signals: Y/C, for example. That is, the control unit 30 can set the exposure timing by comparing the misregistration correction amount corresponding to the image data in C color and the misregistration correction amount corresponding to the image data in Y color, and adjusting one of the misregistration correction amount corresponding to the image data in C color and the misregistration correction amount corresponding to the image data in Y color in order to not result in the correspondence with the even/odd numbers.

Figure 11:
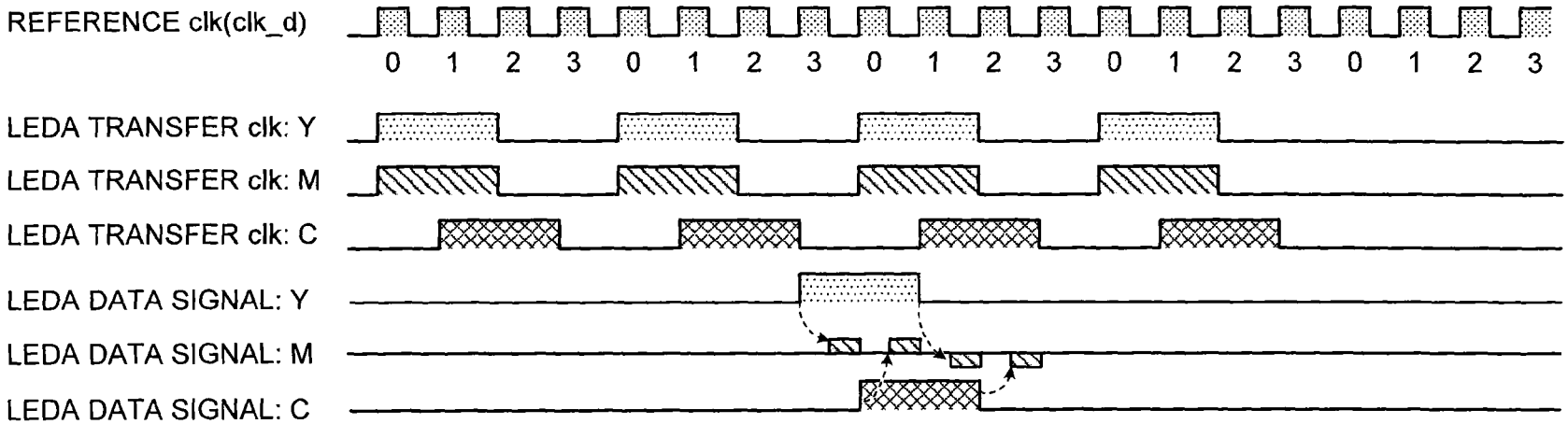
FIG. 11 is a diagram illustrating another method of avoiding the specific crosstalk.

FIG. 11 is a diagram illustrating the method of avoiding the effect of the crosstalk by causing one of the LEDA data signals: Y/C to not be in phase with the LEDA data signal: M. While the setup/hold timing is satisfied for the LEDA transfer clock: M in the example illustrated in FIG. 11, the effect of the crosstalk only comes from one CH so that a DC level is reduced by half not satisfying the DC characteristic, thereby preventing the erroneous data from being transferred. A specific method will be described below.

In this example, the writing position correction amount Y1 is compared with the writing position correction amount C1 to calculate the writing position adjustment amount Y2 and the writing position adjustment amount C2 such that the amounts do not correspond in the even/odd numbers. Note that the writing position adjustment amount M2 is set to the same value as the writing position correction amount M1. When a remainder produced by dividing the writing position correction amount Y1 by 2 matches a remainder produced by dividing the writing position correction amount C1 by 2, for example, there are calculated the writing position adjustment amount C2=the writing position correction amount C1 and the writing position adjustment amount Y2=the writing position correction amount Y1+1 (clk_d).

When the remainder produced by dividing the writing position correction amount Y1 by 2 does not match the remainder produced by dividing the writing position correction amount C1 by 2, there are calculated the writing position adjustment amount C2=the writing position correction amount C1 and the writing position adjustment amount Y2=the writing position correction amount Y1.

The exposure timing is set according to the writing position adjustment amount calculated as described above. Note that there is described the method of shifting by "1" the CH: Y, the FFC of which overlaps that of the target CH: M over a long distance, but either channel may be shifted when there is no difference in the overlapping distance. Moreover, in the present embodiment where the LEDA transfer clock is generated with four divisions as described above, the combination of even/odd numbers is the only combination that does not result in the correspondence. However, the number of combinations that does not result in the correspondence increases when the division setting is changed. In this case, the control unit 30 may set the exposure timing by comparing the misregistration correction amount corresponding to the image data in C color and the misregistration correction amount corresponding to the image data in Y color, and adjusting one of the misregistration correction amount corresponding to the image data in C color and the misregistration correction amount corresponding to the image data in Y color in order to not result in the correspondence with the value according to the division setting.

Therefore, in the present embodiment, the effect caused by the crosstalk can be mitigated by intentionally shifting the phase of the other channel with respect to the channel (M in this example) that is most susceptible to the effect of the crosstalk.

The effect caused by the crosstalk can be avoided with the simple configuration according to the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an exposure unit that performs exposure according to image data and forms a latent image based on the image data on a photoconductor;

a detection unit that detects a misregistration correcting pattern image formed on an image bearer being driven at a predetermined speed;

a calculation unit that calculates a correction amount according to a result of detection of the misregistration correcting pattern image performed by the detection unit, the correction amount indicating an amount of shift of an exposure position from an ideal position; and an exposure control unit that performs control, on the basis of the correction amount, to shift at least one of an exposure timing corresponding to first image data which is input to one of two electric cables in contact with a target electric cable and an exposure timing corresponding to second image data which is input to another one of the two electric cables, with respect to an exposure timing corresponding to target image data which is input to the target electric cable indicating the electric cable, both sides of which are in contact with the two other electric cables, among a plurality of the electric cables which corresponds one-to-one to each of a plurality of the exposure units provided for each of a plurality of colors, to which image data of a corresponding color is input, and which is connected to a corresponding one of the exposure units.

2. The image forming apparatus according to claim 1, wherein the exposure control unit sets an exposure timing by comparing a first correction amount indicating the correction amount corresponding to the target image data with each of a second correction amount indicating the correction amount corresponding to the first image data and a third correction amount indicating the correction amount corresponding to the second image data, and adjusting the second correction amount and the third correction amount so as to not correspond in even/odd numbers.

3. The image forming apparatus according to claim 1, wherein the exposure control unit sets an exposure timing by comparing a first correction amount indicating the correction amount corresponding to the target image data with each of a second correction amount indicating the correction amount corresponding to the first image data and a third correction amount indicating the correction amount corresponding to the second image data, and adjusting the second correction amount and the third correction amount so as to not correspond with a value according to division setting.

4. The image forming apparatus according to claim 1, wherein the exposure control unit sets an exposure timing by comparing a second correction amount indicating the correction amount corresponding to the first image data with a third correction amount indicating the correction amount corresponding to the second image data, and adjusting one of the second correction amount and the third correction amount so as to not correspond in even/odd numbers.

5. The image forming apparatus according to claim 4, wherein the exposure control unit adjusts the second correction amount in order for the second correction amount and the third correction amount to not correspond in even/odd numbers, when the electric cable to which the first image data is input is in contact with the target electric cable over a longer distance than the electric cable to which the second image data is input.

6. The image forming apparatus according to claim 1, wherein the exposure control unit sets an exposure timing by comparing a second correction amount indicating the correction amount corresponding to the first image data with a third correction amount indicating the correction amount corresponding to the second image data, and adjusting one of the second correction amount and the third correction amount so as to not correspond with a value according to division setting.

7. The image forming apparatus according to claim 1, wherein the electric cable is formed of a flexible flat cable.

* * * * *